US005200057A

United States Patent [19]

Canaris

[11] Patent Number: 5,200,057

[45] Date of Patent: Apr. 6, 1993

[54] ADDITIVE COMPOSITION, ACID ZINC AND ZINC-ALLOY PLATING BATHS AND METHODS FOR ELECTRODEDEPOSITING ZINC AND ZINC ALLOYS

[75] Inventor: Valerie M. Canaris, Parma, Ohio

[73] Assignee: McGean-Rohco, Inc., Cleveland, Ohio

[21] Appl. No.: 787,932

[22] Filed: Nov. 5, 1991

[51] Int. Cl.[5] ..... C25D 3/22; C25D 3/56

[52] U.S. Cl. ..... 205/313; 205/245; 205/244; 106/1.17; 106/1.29

[58] Field of Search ..... 205/244, 245, 313, 312; 106/1.29, 1.17; 252/79.1, 500

*Primary Examiner*—John Niebling
*Assistant Examiner*—Brian M. Bolam
*Attorney, Agent, or Firm*—Renner, Otto, Boisselle & Sklar

[57] ABSTRACT

An additive composition is described with comprises a mixture of (a) poly(N-vinyl-2-pyrrolidone), and p0 (b) at least one sulfur-containing compound selected from compounds of the formulae $$RS(R'O)_nH \quad (I)$$

or $$S—[(R'O)_nH]_2 \quad (II)$$

wherein R is hydrogen or an alkyl group containing up to about 24 carbon atoms, each R' is independently an alkylene group containing 2 or 3 carbon atoms, and each n is independently an integer of from 1 to about 100.

This additive composition is useful in acidic plating baths containing zinc or a mixture of zinc ions and at least one additional metal selected from nickel and cobalt. The plating baths also contain chloride ions or a mixture of chloride and sulfate ions.

28 Claims, No Drawings

ADDITIVE COMPOSITION, ACID ZINC AND ZINC-ALLOY PLATING BATHS AND METHODS FOR ELECTRODEDEPOSITING ZINC AND ZINC ALLOYS

TECHNICAL FIELD

This invention relates to additive compositions, plating baths and methods of electrodepositing zinc and zinc alloys. More particularly, the invention relates to additive compositions and zinc and zinc-alloy plating baths containing poly(N-vinyl-2-pyrrolidone) and certain sulfur-containing compounds.

BACKGROUND OF THE INVENTION

Considerable attention has been directed to providing improved corrosion protection to metallic surfaces. One way of providing this corrosion protection is by electrodepositing a zinc coating on the surface. For decades, electroplated zinc has been used by the automative industry to provide an economical, highly corrosion-resistant coating. However, with today's unprecedented demands for higher quality and extended warranties, both the automotive manufacturers and their suppliers have had to develop new coatings. Zinc deposits from electroplating baths have been modified to provide improved overall brightness, range of allowable current densities and ductility. Good overall performance also is being demonstrated by zinc-cobalt and zinc-nickel alloy platings. These alloys are being introduced as replacements for conventional zinc electroplates in automotive as well as other applications requiring extended corrosion-resistance. The term "alloy", as used in this specification and claims is defined as a mixture of two or more metallic elements which may be microscopically hc mogeneous or microscopically heterogeneous.

In recent years, the activity in the plating area has been concentrated on the development of cyanide-free alkaline baths or improvements in acid plating baths. This invention relates to acid zinc and zinc-alloy baths. Typically, acid zinc plating baths are based on a suitable inorganic zinc salt such as zinc chloride or zinc sulfate, and the baths usually include buffers such as the corresponding ammonium salt. Other additives are included in the baths to promote and improve ductility, brightness, throwing power and covering power. Surface active agents are normally included to improve crystal structure, reduce pitting, and increase the solubility of other additives.

Brighteners for acid zinc baths are described in U.S. Pat. No. 3,920,528 which are compounds having a carboxyl or a sulfo group attached directly or through an alkylene, vinyl, carbonyl or phenyl group to various heterocyclic rings including pyrrolidine or pyrrolidone.

Polyvinylpyrrolidone (PVP) has been incorporated into zinc plating baths to impart various desirable properties. U.S. Pat. No. 4,397,717 describes alkaline zinc electroplating baths which contain various additives including polyvinylpyrrolidone. The use of polyvinylpyrrolidone in acid zinc plating baths is described in U.S. Pat. Nos. 3,594,291, 3,891,520, 3,919,056, 4,226,682 and 4,444,630. In U.S. Pat. No. 3,594,291, a brightener system is described for acid zinc plating solutions which comprises the combination of N-polyvinylpyrrolidone with a secondary brightener which is a carbonyl compound such as acetophenone, benzalacetone, etc. The concentration of the polyvinylpyrrolidone in the bath is between 0.5 to 100 g/l. The combination is reported to produce a level of brightness which is greater than the individual effects. Polyvinylpyrrolidone is described as a surfactant in the acid zinc plating baths described in U.S. Pat. No. 3,919,056, and U.S. Pat. No. 4,226,682 describes the use of certain specified dispersing agents including PVP in combination with a brightener compound such as 1-phenyl-1-penten-3-one.

U.S. Pat. No. 2,495,668 describes plating baths for electrodepositing copper wherein the plating bath contains, in addition to copper cyanide, sulfur compounds such as $\beta$-mercaptoethanol, dithiodiglycol, $\beta,\beta'$dihydroxyethyl sulfide and thioglycolic acid. Polymeric sulfur-containing compounds having the general formulae $RS(R'O)_nH$ and $S[(R'O)_nH]_2$ wherein R is an alkyl group containing up to about 24 carbon atoms, each R' is independently an alkylene group containing 2 or 3 carbon atoms, and each n is independently an integer of from 1 to about 100 have been described in U.S. Pat. No. 4,229,268 as being useful in providing a level and bright zinc deposit from acid zinc plating baths. In U.S. Pat. No. 4,832,802, these polymeric sulfur-containing compounds, in combination with a ductility-improving amount of at least one specified acetylenic derivative, provide an additive composition for aqueous acidic zinc-nickel plating baths useful in depositing level and bright zinc-nickel alloy deposits.

SUMMARY OF THE INVENTION

An additive composition is described with comprises a mixture of (a) poly(N-vinyl-2-pyrrolidone), and (b) at least one sulfur-containing compound selected from compounds of the formulae $$RS(R'O)_nH \quad (I)$$

or $$S—[(R'O)_nH]_2 \quad (II)$$

wherein R is hydrogen or an alkyl group containing up to about 24 carbon atoms, each R' is independently an alkylene group containing 2 or 3 carbon atoms, and each n is independently an integer of from 1 to about 100. This additive composition is useful in acidic plating baths containing zinc or a mixture of zinc ions and at least one additional metal selected from nickel and cobalt. The plating baths also contain chloride ions or a mixture of chloride and sulfate ions. The plating baths of the invention provide bright and ductile electrodeposits at low current densities.

DESCRIPTION OF THE PREFERRED EMBODIMENTS

The additive compositions of the present invention comprise a mixture of (a) poly(N-vinyl-2-pyrrolidone), and (b) at least one sulfur-containing component selected from compounds of the formulae $$RS(R'O)_nH \quad (I)$$

or $$S—[(R'O)_nH]_2 \quad (II)$$

wherein R is hydrogen or an alkyl group containing up to about 24 carbon atoms, each R' is independently an alkylene group containing 2 or 3 carbon atoms, and each n is independently an integer of from 1 to about 100. In one embodiment, the additive compositions comprise from about 10 to about 90 parts by weight of the poly(N-vinyl-2-pyrrolidone), and from about 10 to about 90 parts by weight of the sulfur-containing component(b).

The poly(N-vinyl-2-pyrrolidones) useful in the additive compositions of the present invention include polymers characterized by the following general formula (III)

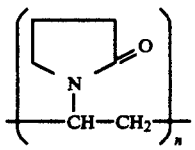

wherein n is an integer of from about 50 to about 5000. The degree of polymerization of the polyvinyl pyrrolidones is not critical. Thus, the polyvinyl-pyrrolidones may have molecular weights of from about 4500 to about 500,000. In one embodiment, n in Formula (III) is from about 90 to about 3500. Satisfactory results are obtained, for example, with a polymer having a molecular weight of from about 10,000 to about 30,000. Poly(N-vinyl-2-pyrrolidones) are available commercially from a variety of sources including GAF. For example, PVP K-15 is a poly(N-vinyl-2-pyrrolidone) is available from GAF Chemicals Corporation.

The sulfur-containing compositions which have been found to be useful in the additive compositions and the plating baths of the present invention are characterized by the following general formulae $$RS(R'O)_nH \quad (I)$$

or $$S—[(R'O)_nH]_2 \quad (II)$$

wherein R is hydrogen or an alkyl group containing up to about 24 carbon atoms, each R' is independently an alkylene group containing 2 or 3 carbon atoms, and each n is independently an integer of from 1 to about 100. The compositions according to Formula (I) can be prepared by reacting hydrogen sulfide, a mercaptan with from 1 to about 100 moles of ethylene or propylene oxide or mixtures of such oxides. An alkaline catalyst generally is used in promoting the condensation reaction. Examples of alkaline catalysts include alkali metal hydroxides, oxides and alcoholates. The preparation of compounds represented by Formula (I) is described in more detail in U.S. Pat. No. 2,494,610 which disclosure is hereby incorporated by reference.

Compounds of the type represented by Formula (II) can be prepared by reacting one mole of hydrogen sulfide, 2-hydroxyethyl sulfide or 3-hydroxypropyl sulfide with from 1 to 100 moles of ethylene or propylene oxide or mixtures of such oxides. A minimum of 2 moles of the oxide is required if the initial sulfur compound is hydrogen sulfide. Preferably, an excess of the oxide and an alkaline catalyst can be employed.

In one preferred embodiment, the sulfur-containing composition is derived from one mole of hydrogen sulfide or 2-hydroxyethyl sulfide and up to 100 moles of ethylene oxide. For example, a useful compound is obtained by reacting 1 mole of 2-hydroxyethyl sulfide with 21 moles of ethylene oxide. In another embodiment, the hydrogen sulfide is replaced by a mercaptan containing 6 to 24 carbon atoms.

Sulfur-containing compositions of the type useful in the plating baths of the present invention also are available from GAF under the general trade designation "PEGOL TDG" and from the Alcolac Company under the general trade designation "SIPONIC". An example is PEGOL TDG 1250 which is the product obtained by ethoxylating 2-hydroxyethyl sulfide with about 28–30 moles of ethylene oxide.

The additive compositions of the present invention are useful in particular in acidic zinc and zinc alloy electroplating baths. The additive compositions comprising a PVP and the above-described sulfur-containing compounds produce zinc and zinc-alloy deposits exhibiting improved brightness and ductility at low current densities.

The aqueous acidic zinc and zinc-alloy plating baths to which the additive compositions of the present invention may be added include the conventional zinc and ammonium containing plating baths as well as the ammonium-free acidic plating baths known to those skilled in the art. The zinc plating baths of the present invention contain free zinc ions and may be prepared with zinc sulfate, zinc chloride, zinc fluoborate, zinc acetate, zinc sulfamate and/or zinc alkane sulfonic acid, e.g., zinc methane sulfonate. The zinc ion concentration in the plating baths may range from about 5 g/l to about 180 g/l with concentrations of from about 7.5 to about 100 g/l being preferred and from about 10–40 g/l being most preferred.

When the plating baths are zinc-alloy plating baths, the baths contain nickel and/or cobalt ions in addition to zinc. The nickel ions may be present in the aqueous plating bath in the form of aqueous-soluble salts such as nickel chloride, nickel sulfate, nickel fluoborate, nickel acetate, nickel sulfamate, and nickel alkane sulfonic acid salts. When cobalt ions are present in the aqueous plating baths of the present invention, the cobalt is usually present in the form of cobalt sulfate, cobalt chloride, cobalt fluoborate, cobalt sulfamate and cobalt acetate. When present in the plating baths, the nickel ions and the cobalt ions generally are present in concentrations of from about 10 to about 150 g/l.

The plating baths of the invention generally will contain one or more conducting salts such as sodium chloride, sodium fluoride, sodium sulfate, potassium chloride, potassium fluoride, potassium sulfate and ammonium chloride, ammonium fluoride and ammonium sulfate. The conductive salts may be present in the plating baths in amounts ranging from about 50 to about 300 g/l or more. The plating baths of the present invention contain chloride ions or mixtures of fluoride ions and sulfate ions. Preferably the baths contain chloride ions but no sulfate ions. The concentration of chloride ions in the baths may range from about 50 to 200 g/l. More often, the concentration of chloride ions is from about 100 to 175 g/l.

Boric acid may be included in the acid zinc and zinc-nickel plating baths of the present invention to serve as a weak buffer to control the pH and the cathode film. The boric acid also may be helpful in smoothing the deposit and is believed to have a cooperative effect with the leveling agents. The concentration of boric acid in the bath is not critical and generally will be in the range of up to about 60 g/l. In one embodiment the boric acid concentration in the plating baths is from about 10–40 g/l.

The acidity of the acid baths of the present invention may vary from a pH of from 0 to about 6.5 or 7. The pH may be lowered if desired by the addition of acid solution such as 10% sulfuric acid solution. If the pH falls below the desired operating range, it can be increased by the addition of ammonium hydroxide or potassium hydroxide. Preferably, the acid-zinc plating baths are operated at a pH of from about 3 or 4 to about 6.5.

The amount of the additive compositions of the present invention which comprise PVP and at least one of the sulfur-containing components described above which is included in the acidic plating baths of the present invention is an amount sufficient to provide a bright zinc deposit. The additive composition may be preformed as a mixture and added to the plating bath, or the components of the additive composition can be added individually to the acid plating baths of the invention. The acidic plating baths of the present invention containing a poly(N-vinyl-2-pyrrolidone) and a sulfur-containing compound characterized by Formulae (I) and/or (II) can be prepared by either technique, and plating baths thus prepared generally will contain from about 0.1 to about 10 g/l of the poly(N-vinyl-2-pyrrolidone) and from about 0.1 to about 15 g/l of the sulfur-containing compound.

When the additive compositions of the present invention are preformed and added to an acidic plating bath, the additive composition may be an aqueous additive composition comprising water, and (a) from about 10 to about 60 g/l of poly(N-vinyl-2-pyrrolidone) and (b) from about 25 to about 150 g/l of at least one of the sulfur-containing compounds of Formulae (I) and/or (II).

The brightness of the zinc and zinc-alloy deposited from the aqueous acidic plating baths described above is improved when the bath also contains at least one carbonyl-containing compound such as aromatic and olefinic aldehydes, ketones, carboxylic acids and salts of carboxylic acids. The supplementary brighteners impart optimum leveling action over a wide current density range. The following compounds illustrate the types of carbonyl-containing compounds which are useful as brighteners in the plating baths of the invention, and these carbonyl compounds include aldehydes, ketones and carboxylic acids, esters and salts, particularly olefinic and carboxylic acids, esters and salts thereof: ortho-chlorobenzaldehyde, para-chlorobenzaldehyde, o-hydroxybenzaldehyde, aminobenzaldehyde, veratraldehyde, benzylidene acetone, coumarin, 3,4,5,6-tetrahydrobenzaldehyde, acetophenone, propiophenone, furfurylidene acetone, 3-methoxybenzal acetone, benzaldehyde, vanillin, hydroxybenzaldehyde, anisicaldehyde, benzoic acid, sodium benzoate, sodium salicylate, 3-pyridine carboxylic acid (nicotinic acid), methacrylic acid, methyl methacrylate, sodium methacrylate, etc. Mixtures of one or more of the acids with one or more ketones also are useful. When employed in the baths of the invention, the carbonyl-containing brighteners will be included within the range of from about 0.02 to about 5 g/l. The carbonyl-containing brighteners may be added directly to the plating baths, or the brighteners can be included in the additive compositions of the invention, and the composition can thereafter be added to or used in the preparation of the acidic plating baths of the invention. When included in the aqueous additive compositions, the additive compositions may contain from about 50 to about 200 g/l of the carbonyl brightener.

The properties of the zinc and zinc-alloy deposited from the aqueous acidic plating baths of the invention may be enhanced further by including in the bath, (or additive composition) small amounts of at least one anionic aromatic sulfonic acid or salt thereof. These compounds are obtained by the polycondensation of formaldehyde and an aromatic sulfonic acid which generally is a naphthalene sulfonic acid. Polycondensation products of this type are known compounds and their production has been described in the literature such, for example, Houben-Weyl, "Methoden Der Organishen Chemie", Vol. XIV/2 at page 316, and said description is hereby incorporated by reference. The utility of these condensation products in acid zinc baths is described in U.S. Pat. Nos. 3,878,069 and 4,075,066.

The general method of preparing these polycondensation products involves reaction of a formaldehyde solution with naphthalene sulfonic acid at a temperature of from about 60° C. to about 100° C. until the formaldehyde odor has disappeared. Similar products can be obtained by sulfonation of naphthalene formaldehyde resins. The condensation products obtained in this manner contain two or more naphthalene sulfonic acids linked by methylene bridges which can have from one to three sulfonic acid groups.

Some examples of aromatic sulfonic acids which may be used include: a bath-soluble salt of tetrahydronaphthalene sulfonic acid such as those available commercially from DuPont; a bath-soluble salt of a xylene sulfonic acid such as those available from Arco Chemical Company under the general trade designation "Ultrawet"; and a bath-soluble salt of cumyl sulfonic acid.

These anionic aromatic sulfonic acid compounds may be introduced into the plating baths either in their acid form or as the water-soluble salts which may be the sodium or potassium salts.

Polycondensation products of these types are available commercially from GAF under the general trade designations BLANCOL N and BLANCOL DISPERSANT; from BASF under the designation TAMOL NNO; from Kokko Corporation under the designation DEMOL N; and from Stepan Chemical Company under the designation STEPANTAN A. These condensation products are included in the baths of the present invention in amounts which may be varied depending upon other ingredients in the plating bath, and generally, the amounts which improve the brightness is from about 0.1 to about 15 g/l of plating bath.

The plating baths of the invention also may contain at least one nonionic ethylene oxide and/or propylene oxide condensate surfactant. These surfactants may be selected from the group consisting of ethoxylated alkyl phenols, ethoxylated fatty alcohols, ethoxylated fatty acids, ethoxylated fatty acid amides, polyethylene oxide condensates, and block copolymers of ethylene oxide and propylene oxide based on propylene glycol or ethylene glycol. Generally, the surfactants will contain up to about 40 or more ethylene oxide units. The amount of nonionic surfactant included in the baths of the invention may vary over a wide range although it is preferred to include from about 0.5 to about 10 g/l of the condensate in the bath.

The ethoxylated alkyl phenols may be represented by the formula

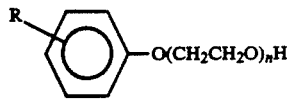

(IV)

wherein R is an alkyl group containing up to about 20 carbon atoms and n is an integer from about 10 to about 30. Preferably the alkyl group contains from about 6 to 20 carbon atoms. Examples of such alkyl groups include octyl, isooctyl, nonyl, dodecyl, octadecyl. Ethoxylated alkyl phenols are available commercially under a variety of trademarks such as "Surfonic" from Jefferson Chemical Co., "Renex" from Atlas Chemical Industries, Inc., and "Igepal" from GAF Corporation Chemical Products.

Polyethylene oxide or polyethylene glycol condensates having different molecular weights have been found to give good results. Condensates of this type which may be represented by the general formula $$HO(CH_2CH_2O)_nH \quad (V)$$

wherein n is an integer from about 5 to about 100 or more are known in the art and are commercially available such as for example under the general trade designation Carbowax from Union Carbide. Specific examples include Carbowax No. 1000 which has a molecular weight range of from about 950 to 1050 and contains from 20 to 24 ethoxy units per molecule. Carbowax No. 4000 has a molecular weight range of from about 3000 to 3700 and contains from 68 to 85 ethoxy units per molecule.

Ethoxylated aliphatic alcohols are useful as surfactants in the plating baths of the invention and may be characterized by the formula $$RO(CH_2CH_2O)_n\text{-}H \quad (VI)$$

wherein R is an alkyl group containing from about 8 to 24 carbon atoms and n is an integer of from 5 to about 30. Fatty alcohols such as tridecyl oleyl and stearyl are preferred examples. A number of ethoxylated aliphatic alcohols are available commercially such as from Emery Industries under the general trademark "Trycol". A specific example is "Trycol OAL-23" which is an ethoxylated oleyl alcohol.

Alkoxylated alcohols also are available from Chemax, Inc. under the general trade designation "Chemal". Examples include Chemal TDA which is an ethoxylated tridecyl alcohol, Chemal OA which is an ethoxylated oleyl alcohol and Chemal LA, an ethoxylated lauryl alcohol.

The surfactant also may be an ethoxylated fatty acid represented by the formula $$RC(O)\text{—}O(CH_2CH_2O)_nH \quad (VII)$$

or an ethoxylated fatty acid amide represented by the formula $$RC(O)\text{—}N(H)(CH_2CH_2O)_nH \quad (VIII)$$

wherein R is an alkyl carbon chain containing from about 8 to 24 carbon atoms and n is an integer from about 5 to about 20.

The ethoxylated fatty acid can be obtained by reacting ethylene oxide with a fatty acid such as oleic acid, stearic acid, palmitic acid, etc. The ethoxylated fatty acids are available commercially such as from Armak Industries, Chemical Division under the trademark "Ethofat". Specific examples are: Ethofat C/15, coco acid ethoxylated with 5 moles of ethylene oxide, and Ethofats O/15 and O/20, which are oleic acid reacted with 5 and 10 moles of ethylene oxide respectively. The ethoxylated fatty acid amides can be obtained by reacting ethylene oxide with a fatty acid amide such as oleamide, stearamide, coconut fatty acid amides and lauric amide. The ethoxylated fatty acid amides, which may also be identified as ethoxylated alkylolamides are commercially available from, for example, The Stepan Chemical Company under the general trade designation Amidox, and from Armak under the trademark ETHOMID.

Another type of nonionic ethoxylated surfactant which is useful in the plating baths of the invention are block copolymers of ethylene oxide and propylene oxide based on a glycol such as ethylene glycol or propylene glycol. The copolymers based on ethylene glycol generally are prepared by forming a hydrophilic base by reaction of ethylene oxide with ethylene glycol followed by condensation of this intermediate product with propylene oxide. The copolymers based on propylene glycol similarly are prepared by reacting propylene oxide with propylene glycol to form the intermediate compound which is then condensed with ethylene oxide. By varying the proportions of ethylene oxide and propylene oxide used to form the above copolymers, the properties may be varied. Both of the above types of copolymers are available commercially such as from BASF Wyandotte under the general trademark PLURONIC. The condensates based on ethylene glycol are identified as the "R" series, and these compounds preferably contain from about 30 to about 80% of polyoxyethylene in the molecule and may be either liquids or solids. The condensates based on propylene glycol are identified generally by BASF Wyandotte as the "F", "L", or "P" series and these may contain from about 5 to about 80% of ethylene oxide. The "L" series of propylene glycol based copolymers are liquids, the "F" series are solids and the "P" series are pastes. The solids and pastes can be used when they are soluble in the bath formulation. The molecular weights of these block copolymers range from about 400 to about 14,000.

The acidic plating baths of the present invention also may be improved by the incorporation therein of small amounts of bath-soluble metal salts of the sulfate ester of 2-ethyl-1-hexanol. These sodium salts are available commercially from a number of vendors including, for example, Niaset Corporation under the designation NIAPROOF O8; The Henkel Chemicals Company (Canada) under the designation SULFOTAX CA; from BASF under the trade designation LUGALVAN TC-EHS; etc. From about 0.1 to about 15 g/l of these salts can be included in the plating baths of the present invention.

The acid plating baths of the present invention deposit a level, bright and ductile zinc or zinc alloy on substrates at any conventional temperature such as from about 25° C. to about 60° C. Still plating baths generally will be operated at a lower range of the temperature such as from about 25° C. to about 40° C. whereas high-speed plating baths for strip or wire-plating may be operated over the entire range of from about 25° C. to about 60° C. The baths of the present invention may also be used in barrel plating. If the bath is to be agitated, an antifoaming agent should be included. An example of a useful antifoaming agent is a mixture of Dow Corning A and sodium sulfate.

Solvents for improving the solubility of benzylidene acetone in the plating baths and additive compositions are also desirable. Examples of solubilizers include: 2-methoxy ethanol; ethylene glycol ethyl ether; propylene glycol methyl ether; propylene glycol-n-butyl ether, and butyl cellosolve.

The following examples illustrate the additive compositions or concentrates which may be prepared and utilized in accordance with the invention for preparing or maintaining acid baths of the invention and/or improving the performance of the baths.

| | |
|---|---|
| Additive Composition-1 | |
| PVP | 50 g |
| Ethoxylated (21 ETO) 2-hydroxyethyl sulfide | 50 g |
| Additive Composition-2 | |
| PVP | 30 g/l |
| TDG-1250 | 75 g/l |
| Water to | 1 liter |
| Additive Composition-3 | |
| PVP K-15 | 36 g/l |
| TDG-1250 | 86 g/l |
| Sodium benzoate | 132 g/l |
| Water to | 1 liter |
| Additive Composition-4 | |
| Propylene glycol methyl ether | 600 cc |
| Benzylidene acetone | 60 g/l |
| Blancol N | 0.34 g/l |
| PVP K-15 | 0.12 g/l |
| Chemal TDA-15 | 0.44 g/l |
| TDG-1250 | 0.29 g/l |
| Sodium benzoate | 0.44 g/l |
| Water to | 1 liter |
| Additive Composition-5 | |
| Chemal TDA-15 | 57.3 g/l |
| Blancol N | 44.0 g/l |
| pH to 6.0–6.5 with HCl | |
| Water to | 1 liter |

The following Examples 1–10 illustrate typical aqueous acidic zinc and zinc alloy plating baths to which various additive compositions may be added in accordance with the present invention.

| | |
|---|---|
| Example 1 | |
| Zinc chloride | 41.6 g/l |
| Potassium chloride | 229 g/l |
| Boric acid | 20 g/l |
| Example 2 | |
| Zinc chloride | 105 g/l |
| Potassium chloride | 210 g/l |
| Boric acid | 20 g/l |
| Example 3 | |
| Zinc chloride | 28 g/l |
| Ammonium chloride | 202.5 g/l |
| Example 4 | |
| Zinc chloride | 33.4 g/l |
| Ammonium chloride | 60.75 g/l |
| Potassium chloride | 137.4 g/l |
| Boric acid | 38.75 g/l |
| Example 5 | |
| Zinc chloride | 38.5 g/l |
| Potassium chloride | 67.5 g/l |
| Ammonium chloride | 76.3 g/l |
| Sodium chloride | 56.4 g/l |
| Boric acid | 22.5 g/l |
| Example 6 | |
| Zinc chloride | 20.8 g/l |
| Zinc sulfate monohydrate | 14.0 g/l |
| Potassium sulfate | 60.0 g/l |

-continued

| | |
|---|---|
| Potassium chloride | 114.5 g/l |
| Boric acid | 10.0 g/l |
| Example 7 | |
| Zinc Chloride | 100 g/l |
| Nickel Chloride | 155 g/l |
| Ammonium Chloride | 240 g/l |
| Concentrated Ammonium Hydroxide Solution | 75 g/l |
| Example 8 | |
| Zinc Chloride | 35 g/l |
| Nickel Sulfate | 102 g/l |
| Ammonium Chloride | 120 g/l |
| Concentrated Ammonium Hydroxide Solution | 40 g/l |
| Example 9 | |
| Zinc chloride | 73 g/l |
| Cobalt chloride hexahydrate | 32 g/l |
| Sodium chloride | 125 g/l |
| Boric acid | 30 g/l |
| Example 10 | |
| Zinc chloride | 35 g/l |
| Nickel chloride hexahydrate | 40 g/l |
| Cobalt chloride hexahydrate | 20 g/l |
| Boric acid | 30 g/l |

The following examples illustrate the aqueous acidic plating baths of the invention. The utility of the baths is demonstrated by plating steel Hull Cell panels on a 267 ml. Hull Cell.

Bath A

Bath of Example 1 to which is added 1% of Additive Composition-3 and

| | |
|---|---|
| Chemal TDA-15 | 1.72 g/l |
| Blancol N | 1.32 g/l |
| Benzylidene acetone | 0.045 g/l |
| Propylene glycol methyl ether | 0.45 g/l |

Bath B

Bath of Example 3 to which is added

| | |
|---|---|
| Additive Composition 3 | at 1% |
| Additive Composition 4 | at 0.75 cc/l |
| Additive Composition 5 | at 3% |

A 2 amp, 5 minute Hull Cell panel at 110° F. with mechanical agitation is ductile and bright overall.

Bath C

Bath of Example 4 to which is added

| | |
|---|---|
| Additive Composition 3 | at 1% |
| Additive Composition 4 | at 0.75 cc/l |
| Additive Composition 5 | at 3% |

A 2 amp, 5 minute Hull Cell panel at 110° F. with mechanical agitation is ductile and bright down into extremely low current densities.

Bath D

Bath of Example 5 to which is added

| | |
|---|---|
| Additive Composition 3 | at 1% |
| Additive Composition 4 | at 0.75 cc/l |

-continued

| | |
|---|---|
| Additive Composition 5 | at 3% |

A 2 amp, 5 minute Hull Cell panel at 110° F. with mechanical agitation is ductile and bright down into extremely low current densities.

Bath E

Bath of Example 6 to which is added

| | |
|---|---|
| Additive Composition 3 | at 1% |
| Additive Composition 4 | at 0.75 cc/l |
| Additive Composition 5 | at 3% |

A 2 amp, 5 minute Hull Cell panel at 110° F. with mechanical agitation is ductile and bright up to 125 apsf. The results are improved over a similar bath containing sulfate ions but no chloride ions.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

I claim:

1. An additive composition comprising a mixture of
(a) poly(N-vinyl-2-pyrrolidone), and
(b) at least one sulfur-containing compound selected from compounds of the formulae $$RS(R'O)_nH \quad (I)$$

or $$S—[(R'O)_nH]_2 \quad (II)$$

wherein R is hydrogen or an alkyl group containing up to about 24 carbon atoms, each R' is independently an alkylene group containing 2 or 3 carbon atoms, and each n is independently an integer of from 1 to about 100.

2. The additive composition of claim 1 wherein the mixture comprises from about 10 to about 90 parts by weight of (a) and from about 10 to 90 parts by weight of (b).

3. The additive composition of claim 1 wherein the sulfur-containing compound (b) is characterized by Formula (II).

4. The additive composition of claim 1 also contains (c) at least one aromatic carbonyl-containing compound.

5. The additive composition of claim 4 wherein the aromatic carbonyl-containing compound (c) is an aromatic carboxylic acid or bath-soluble salt thereof.

6. An aqueous additive composition for aqueous acidic zinc and zinc alloy electroplating baths comprising water, and
(a) from about 10 to about 60 g/l of poly(N-vinyl-2-pyrrolidone), and
(b) from about 25 to about 150 g/l of at least one sulfur-containing compound of the formulae $$RS(R'O)_nH \quad (I)$$

or $$S—[(R'O)_nH]_2 \quad (II)$$

wherein R is hydrogen or an alkyl group containing up to about 24 carbon atoms, each R' is independently an alkylene group containing 2 or 3 carbon atoms, and each n is independently an integer of from 1 to about 100.

7. The aqueous additive composition of claim 6 also containing (c) from 50 to 200 g/l of at least one aromatic carboxylic acid or bath-soluble salt thereof.

8. An aqueous acidic plating bath for electrodepositing zinc or a zinc alloy on a substrate comprising water and
(a) zinc ions or a mixture of zinc ions and at least one additional metal selected from nickel and cobalt,
(b) chloride ions, or a mixture of chloride and sulfate ions,
(c) a poly(N-vinyl-2-pyrrolidone), and
(d) at least one sulfur-containing compound of the formulae $$RS(R'O)_nH \quad (I)$$

or $$S—[(R'O)_nH]_2 \quad (II)$$

wherein R is hydrogen or an alkyl group containing up to about 24 carbon atoms, each R' is independently an alkylene group containing 2 or 3 carbon atoms, and each n is independently an integer of from 1 to about 100.

9. The plating bath of claim 8 wherein the sulfur-containing compound is prepared by reacting one mole of hydrogen sulfide or 2-hydroxyethyl sulfide with up to about 150 moles of ethylene oxide or propylene oxide.

10. The plating bath of claim 8 also containing (e) at least one aromatic carbonyl-containing compound.

11. The plating bath of claim 10 wherein the aromatic carbonyl-containing compound is an aromatic aldehyde, ketone or carboxylic acid or bath-soluble salt thereof.

12. The plating bath of claim 10 wherein the aromatic carbonyl-containing compound is an aromatic carboxylic acid or bath-soluble salt thereof.

13. The plating bath of claim 8 also containing at least one anti-foaming agent.

14. The plating bath of claim 10 wherein the bath contains a mixture of an aromatic carboxylic acid or bath-soluble salt thereof and an aromatic ketone.

15. An aqueous acidic plating bath for electrodepositing zinc on a substrate which comprises
(a) zinc ions
(b) chloride ions
(c) an amount sufficient to provide a bright zinc deposit of a mixture of
(c-1) a poly(N-vinyl-2-pyrrolidone) and
(c-2) a sulfur-containing compound characterized by the formulae $$RS(R'O)_nH \quad (I)$$

or $$S—[(R'O)_nH]_2 \quad (II)$$

wherein R is hydrogen or an alkyl group containing up to about 24 carbon atoms, each R' is independently an alkylene group containing 2 or 3 carbon atoms, and each n is independently an integer of from 1 to about 50.

16. The plating bath of claim 15 wherein the mixture (c) contains 10–50 parts by weight of (c-1) and 50–90 parts of (c-2).

17. The plating bath of claim 15 wherein the sulfur-containing compound (c-2) is prepared by reacting hydrogen sulfide or 2-hydroxyethyl sulfide with up to 100 moles of ethylene oxide or propylene oxide.

18. The plating bath of claim 15 wherein the sulfur-containing compound (c-2) is obtained by reacting hydrogen sulfide or 2-hydroxyethyl sulfide with from 15 to 40 moles of ethylene oxide.

19. The plating bath of claim 15 containing from about 0.1 to about 10 g/l of bath of (c-1) and from about 0.1 to about 15 g/l of bath of (c-2).

20. The plating bath of claim 15 also containing (d) at least one aromatic carbonyl-containing compound selected from aromatic aldehydes, ketones and carboxylic acids or bath-soluble salts thereof.

21. The plating bath of claim 20 wherein the aromatic carbonyl-containing compound is an aromatic carboxylic acid or bath-soluble salt thereof.

22. The plating bath of claim 15 also containing (e) at least one anionic aromatic sulfonic acid condensate or bath-soluble salt thereof.

23. The plating bath of claim 22 wherein the sulfonic acid condensate is obtained by the polycondensation of formaldehyde and an aromatic sulfonic acid.

24. The plating bath of claim 15 also containing (f) at least one nonionic surfactant.

25. The plating bath of claim 24 wherein the nonionic surfactant (f) is an ethoxylated aliphatic alcohol, alkyl phenol, or fatty acid.

26. The plating bath of claim 24 wherein the nonionic surfactant (f) is a tridecyl alcohol ethoxylated with from about 7 to about 30 moles of ethylene oxide.

27. A method of electrodepositing a bright zinc or zinc alloy coating on a substrate which comprises electroplating said substrate in an aqueous acidic zinc or zinc alloy plating bath containing the additive composition of claim 1.

28. A method of electroplating a bright zinc coating on a substrate which comprises electroplating said substrate in an aqueous acidic zinc plating bath of claim 15.

* * * * *